US010927728B2

(12) United States Patent
Suzuki et al.

(10) Patent No.: US 10,927,728 B2
(45) Date of Patent: Feb. 23, 2021

(54) OIL PASSAGEWAY STRUCTURE FOR ENGINE

(71) Applicant: Mazda Motor Corporation, Hiroshima (JP)

(72) Inventors: Toshitaka Suzuki, Hiroshima (JP); Jun Nishikawa, Hiroshima (JP); Kazuaki Aizawa, Aki-gun (JP); Yoshinori Sato, Hiroshima (JP)

(73) Assignee: Mazda Motor Corporation, Hiroshima (JP)

( * ) Notice: Subject to any disclaimer, the term of this patent is extended or adjusted under 35 U.S.C. 154(b) by 15 days.

(21) Appl. No.: 16/461,743

(22) PCT Filed: Nov. 16, 2017

(86) PCT No.: PCT/JP2017/041208
§ 371 (c)(1),
(2) Date: May 16, 2019

(87) PCT Pub. No.: WO2018/092827
PCT Pub. Date: May 24, 2018

(65) Prior Publication Data

US 2019/0309668 A1 Oct. 10, 2019

(30) Foreign Application Priority Data

Nov. 21, 2016 (JP) ..... JP2016-225633

(51) Int. Cl.
*F01M 11/02* (2006.01)
*F01M 1/06* (2006.01)

(52) U.S. Cl.
CPC ..... *F01M 11/02* (2013.01); *F01M 1/06* (2013.01); *F01M 2011/021* (2013.01)

(58) Field of Classification Search
CPC ..... F01M 11/02; F01M 1/06; F01M 2011/021
(Continued)

(56) References Cited

U.S. PATENT DOCUMENTS

2006/0288976 A1* 12/2006 Watanabe ..... F01M 11/02 123/196 R
2015/0128886 A1* 5/2015 Ogino ..... F01M 11/0004 123/54.4

(Continued)

FOREIGN PATENT DOCUMENTS

JP 2009174478 A 8/2009
JP 2015028356 A * 2/2015
JP 2015028356 A 2/2015

OTHER PUBLICATIONS

European Patent Office, Extended European Search Report Issued in Application No. 17872669.1, dated Oct. 10, 2019, Germany, 8 pages.

*Primary Examiner* — Joseph J Dallo
*Assistant Examiner* — Yi-Kai Wang
(74) *Attorney, Agent, or Firm* — Alleman Hall Creasman & Tuttle LLP

(57) ABSTRACT

Disclosed is an oil passageway structure for an engine, which comprises: a body-side oil passage; a cover-side oil passage; an oil passage coupling section in which a first mating face formed around a peripheral edge of an endless transmission band cover-facing open end of the body-side oil passage is coupled to a second mating face formed around a peripheral edge of a body-side oil passage-facing open end of the cover-side oil passage; a groove formed in one of the first mating face and the second mating face; a cutout provided in the one mating face formed with the groove; and a sealing member attached to the groove, wherein the sealing member is formed with an outward protrusion protruding beyond an outer edge-side end of the cutout, and the cutout is formed inclinedly with respect to a cylinder axis as viewed in a cylinder row direction.

11 Claims, 8 Drawing Sheets

(58) Field of Classification Search
USPC ..... 123/196 R
See application file for complete search history.

(56) References Cited

U.S. PATENT DOCUMENTS

2017/0114686 A1* 4/2017 Tsukamoto ..... F01M 1/02
2018/0100545 A1* 4/2018 Toyota ..... F16C 33/7886

* cited by examiner

OIL PASSAGEWAY STRUCTURE FOR ENGINE

TECHNICAL FIELD

The present invention relates to an oil passageway structure for an engine, and more particularly to an oil passageway structure for an engine, in which a body-side oil passage inside an engine body and a cover-side oil passage inside an endless transmission band cover are communicated with each other.

BACKGROUND ART

Heretofore, there has been know an oil passageway structure for an engine, which comprises a body-side oil passage formed inside an engine body having plural cylinders, and a cover-side oil passage formed inside a timing chain cover serving as an endless transmission band cover, wherein the two oil passages are communicated with each other (see the following Patent Document 1).

When the two oil passages serving as an oil passageway are formed across between an engine body side and a timing chain cover side in the above manner, there is a problem of ensuring sealing in a coupling portion (oil passage coupling section) between the body-side oil passage and the cover-side oil passage For this reason, in the conventional oil passageway structure disclosed in the Patent Document 1, an oil passage coupling section in which a first mating face formed around a peripheral edge of an open end of the body-side oil passage is coupled to a second mating face formed around a peripheral edge of an open end of the cover-side oil passage is provided, wherein a groove for a sealing member is formed in the second mating face, and an O-ring serving as a sealing member is attached to the groove.

CITATION LIST

Patent Document

Patent Document 1: JP 2009-174478A

SUMMARY OF INVENTION

Technical Problem

The sealing in the oil passage coupling section can be ensured by providing the above sealing member. However, if omission of assembling of the sealing member occurs during assembling of an engine, the sealing in the oil passage coupling section will be deteriorated. Particularly, in an engine equipped with a hydraulically-controlled valve operating mechanism (which is designed, for example, to allow an in-line four-cylinder engine to be operated during light load under the condition that only second and third cylinders are activated while first and fourth cylinders are deactivated), such deterioration in the sealing is likely to lead to difficulty in ensuring a sufficient oil pressure, which causes response delay or malfunction of the valve operating mechanism, resulting in poor fuel economy performance.

Therefore, in a comparative example depicted in FIGS. 8A and 8B, a ring-shaped groove 83 is recessedly formed in the second mating face 84 formed around the peripheral edge of the open end of the cover-side oil passage 81, and a sealing member 84 such as an O-ring is attached to the groove 83. Here, a cutout 85 is formed in an upper region of the mating face 82 to extend from the groove 83 in a cylinder axis direction and open to an outer periphery of the mating face 82, and a protrusion 86 integrally formed on the sealing member 84 is disposed to extend through the cutout 85 and protrude upwardly in the cylinder axis direction through and beyond the cutout 85. Further, with a view to increasing a visual projection area from a sealing member assembling state-checking opening located between an upper end of the endless transmission band cover and an upper end of a cylinder head, a widened portion 87 is integrally formed at an upper end of the protrusion 86.

However, in the structure depicted in FIG. 8A, an increase in weight of a free end of the protrusion 86 due to the widened portion 87 leads to deterioration in durability of a base end of the protrusion 86. Specifically, during engine operation, the widened portion 87 swings due to engine vibration, and the resulting stress concentrates on the base end of the protrusion 86, leading to a problem that the base end of the protrusion 86 fatigues and breaks, as depicted in FIG. 8B.

The present invention has been made to solve the above problem, and an object of the present invention to provide an oil passageway structure for an engine, which is capable of enhancing visibility of a sealing member to prevent omission of assembling of the sealing member, and improving durability of the sealing member.

Solution to Technical Problem

In order to solve the above problem, the present invention provides an oil passageway structure for an engine, which comprises: a body-side oil passage formed inside an engine body having plural cylinders; a cover-side oil passage formed inside an endless transmission band cover which is attached to a lateral surface of one end in a cylinder row direction of the engine body, and covers an endless transmission band; an oil passage coupling section in which a first mating face formed around a peripheral edge of an endless transmission band cover-facing open end of the body-side oil passage is coupled to a second mating face formed around a peripheral edge of a body-side oil passage-facing open end of the cover-side oil passage; an approximately annular-shaped groove formed in at least one of the first mating face and the second mating face; a cutout formed in the at least one mating face to extend from an engine upper region-facing side of the groove outwardly in a radial direction of an associated one of the oil passages and open to an outer edge of the at least one mating face; and a sealing member formed in a shape corresponding to that of the groove and attached to the groove, wherein the sealing member is formed with an outward protrusion having a shape corresponding to that of the cutout and protruding upwardly from an outer periphery of the sealing member, beyond an outer edge-side end of the cutout, and the cutout is formed inclinedly with respect to a cylinder axis as viewed in the cylinder row direction.

In the present invention, the endless transmission band cover may be either of a timing chain cover and a timing belt cover.

In the oil passageway structure of the present invention having the above feature, the cutout (assembling state-checking cutout) formed to communicate with the groove is provided obliquely or inclinedly with respect to the cylinder axis, so that it is possible to largely ensure a projection area of the outward protrusion of the sealing member, when viewing the oil passage coupled section from an upper region of the engine approximately in the cylinder axis direction. This makes it possible to enhance visibility of the outward protrusion, and check the presence or absence of attachment of the sealing member within a short period of time during conveyance of the engine on a conveyer belt in an engine assembling process.

Further, even in a situation where components are disposed above the oil coupled section, the cutout disposed inclinedly facilitates checking of the assembling state from an inter-component space.

In addition, the outward protrusion of the sealing member can be formed such that it is maximally reduced in size, so that, even if the outward protrusion swings due to engine vibration, the resulting fatigue stress to be applied to a base end of the outward protrusion can be reduced, thereby improving durability of the sealing member.

Preferably, in the oil passageway structure of the present invention, as viewed in the cylinder row direction, the oil passage coupling section is provided outside a region surrounded by the endless transmission band, and the cutout is formed such that it is oriented toward an outer edge of the endless transmission band cover.

In this preferred embodiment, the endless transmission band may be composed of a timing chain or a timing belt (cogged belt or toothed belt).

According to this feature, the cutout is oriented toward the outer edge of the endless transmission band cover, so that it is possible to prevent a distal end of the outward protrusion of the sealing member from being oriented toward the endless transmission band, so as to avoid overlapping between the outward protrusion and a region to be darkened by a shadow of the endless transmission band, when visually checking the outward protrusion from the upper region of the engine, thereby enhancing visibility of the outward protrusion.

Further, it is possible to prevent a contact between the endless transmission band and the outward protrusion of the sealing member, which would otherwise be caused by fluttering of the endless transmission band during engine operation.

Preferably, in the oil passageway structure of the present invention, the oil passage coupling section is provided inside a region surrounded by the endless transmission band, and below an intake-side camshaft drive wheel and an exhaust-side camshaft drive wheel around which the endless transmission band is wound, and the cutout is formed such that it is oriented toward an interspace between the intake-side camshaft drive wheel and the exhaust-side camshaft drive wheel, as viewed in the cylinder row direction, In this preferred embodiment, the camshaft drive wheel may be composed of a sprocket wheel (so-called "sprocket") in the case where a timing chain is used as the endless transmission band, or may be composed of a timing pulley in the case where a timing belt is used as the endless transmission band.

According to this feature, the cutout is oriented toward the interspace between the intake-side and exhaust-side camshaft drive wheels, so that it is possible to ensure visibility when visually checking the cutout from the upper region of the engine.

Preferably, in the oil passageway structure of the present invention, the groove is provided in the second mating face.

According to this feature, the groove is provided in the second mating face of the endless transmission band cover, so that the sealing member can be preliminarily attached to the groove. This makes it possible to prevent drop-off of the sealing member during an engine assembling process and improve assembling efficiency.

On the other hand, assume that the groove is provided in the first mating face on the side of the engine body, and the sealing member is preliminarily attached to the groove on the side of the engine body. In this case, the sealing member is likely to drop off during assembly of the endless transmission band and others.

Preferably, in the oil passageway structure of the present invention, the sealing member is formed in an annular shape, wherein the sealing member has an inward protrusion protruding radially inwardly from an inner periphery of the sealing member, and wherein the inward protrusion is provided offset with respect to the outward protrusion, in a circumferential direction of the sealing member.

According to this feature, when oil flows through the oil passages during engine operation, a pressure (internal pressure) is applied to the sealing member from the side of the inner periphery toward the outer periphery of the sealing member.

At this timing, a load is mainly input via the inner protrusion, so that it is possible to suppress a situation where stress is abnormally increased in a part of the sealing member corresponding to a connection between the groove and the cutout, thereby suppressing deterioration in durability of the sealing member.

Effect of Invention

The oil passageway structure of the present invention makes it possible to ensure a projection area of the outward protrusion of the sealing member to enhance visibility of the oil passage coupling section when visually checking the oil passage coupling section from the upper region of the engine approximately in the cylinder axis direction, to thereby prevent omission of assembling of the sealing member, and to reduce fatigue stress to be applied to the base end of the outward protrusion to thereby improve durability of the sealing member.

DESCRIPTION OF EMBODIMENTS

An oil passageway structure for an engine, according to one embodiment of the present invention, will now be described based on the drawings.

Figure 1:
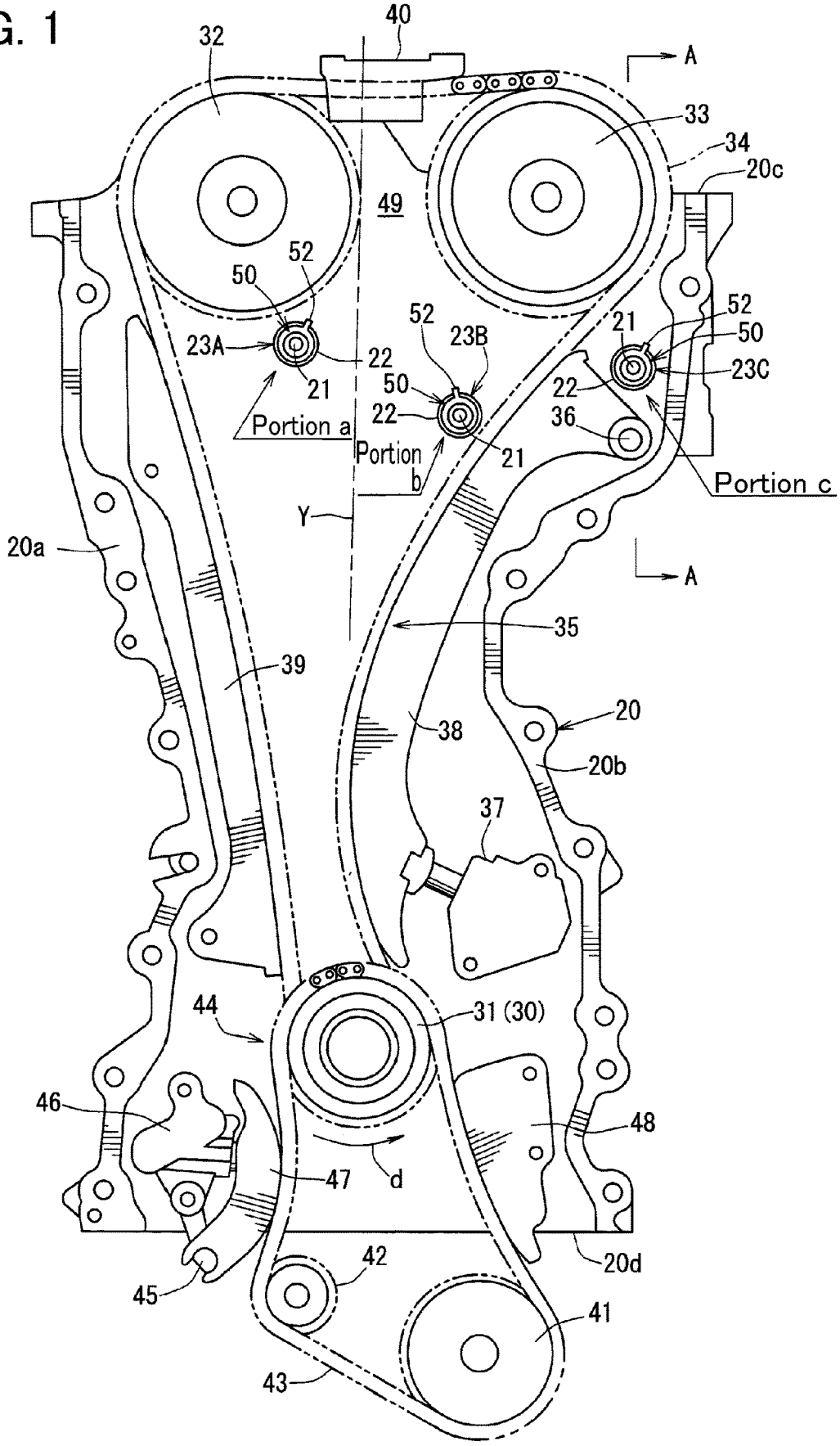
FIG. 1 is an explanatory diagram depicting an oil passageway structure for an engine, according to one embodiment of the present invention, as viewed outwardly from the inside of an endless transmission band cover.

First of all, with reference to FIGS. 1 and 2, a basis structure of the oil passageway structure according to this embodiment will be described. FIG. 1 is an explanatory diagram depicting the oil passageway structure according to this embodiment as viewed outwardly from the inside of an endless transmission band cover, and FIG. 2 is a fragmentary sectional view taken along the line A-A in FIG. 1.

Figure 2:
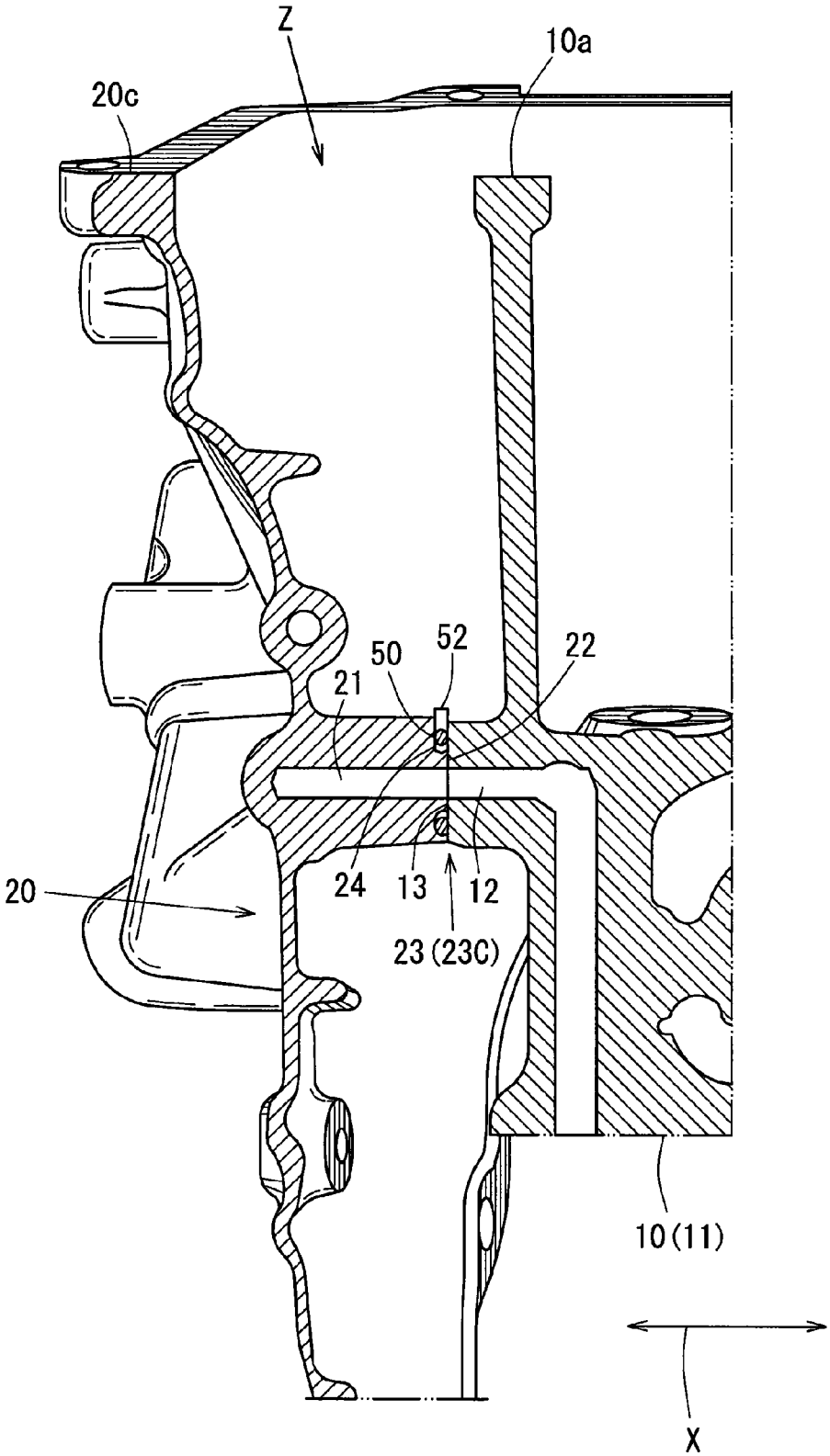
FIG. 2 is a fragmentary sectional view taken along the line A-A in FIG. 1.

In an engine, an engine body 11 comprises a cylinder block, and a cylinder head 10 depicted in FIG. 2. An oil pan is attached to the bottom of the cylinder block, and a head cover is attached to the top of the cylinder head 10.

Plural cylinders are formed inside the cylinder block, and plural intake ports and plural exhaust ports are formed in the cylinder head 10.

Further, as depicted in FIGS. 1 and 2, a timing chain cover 20 serving as an endless transmission band is attached to a lateral surface of one end in a cylinder row direction X of the engine body 11.

As depicted in FIG. 2, a body-side oil passage 12 is formed inside the cylinder head 10 constituting the engine body 11, and a cover-side oil passage 21 is formed inside the timing chain cover 20 to communicate with the body-side oil passage 12.

Further, as depicted in FIG. 2, a first mating face 13 is formed around a peripheral edge of a timing chain cover (21)-facing open end of the body-side oil passage 12, and a second mating face 22 is formed around a peripheral edge of a body-side oil passage (12)-facing open end of the cover-side oil passage 21. These first and second mating faces 13, 22 are brought into contact with each other such that the body-side oil passage 12 aligns with the cover-side oil passage 21. Such a section where the first and second mating faces 13, 22 are mated together is formed as an oil passage coupling section where these first and second mating faces 13, 22 are coupled together.

Here, a piston reciprocatingly movable upwardly and downwardly within each cylinder is coupled to a crankshaft via a connecting rod (so-called "conrod"), and crank sprockets 30, 31 as a pair of endless transmission band drive wheels to be driven by the crankshaft are coaxially provided at one end of the crankshaft in the cylinder row direction X, as depicted in FIG. 1. In the pair of crank sprockets 30, 31, one crank sprocket 30 is disposed closer to the timing chain cover 20, and the other crank sprocket 31 is disposed closer to the engine body 11.

The cylinder head 10 is provided with an intake camshaft for openably and closably driving intake valves via intake cams, and an intake-side cam sprocket 32 serving as an intake-side camshaft drive wheel is provided at one end of the intake camshaft in the cylinder row direction X.

The cylinder head 10 is further provided with an exhaust camshaft for openably and closably driving exhaust valves via exhaust cams, and an exhaust-side cam sprocket 33 serving as an exhaust-side camshaft drive wheel is provided at one end of the exhaust camshaft in the cylinder row direction X.

Then, a first timing chain 34 serving as a first endless transmission band is wound around the crank sprocket 30, the intake-side cam sprocket 32 and the exhaust-side cam sprocket 33, to form a valve-operating transmission mechanism 35 based on these elements 30, 32, 33, 34.

A first lever 38 is provided outside a running line of the first timing chain 34 in a region between the exhaust-side cam sprocket 33 and the crank sprocket 30, and configured such that a free end thereof is adjustably pressed by a first hydraulic tensioner 37, and swung about a support point 36. The first hydraulic tensioner 37 and the first lever 38 function to prevent slack of the first timing chain 34.

Further, a first guide 39 is provided outside and along the running line of the first timing chain 34 in a region between the intake-side cam sprocket 32 and the crank sprocket 30. The first guide 39 functions to guide the first timing chain 34.

Furthermore, a second guide 40 is provided outside the running line of the first timing chain 34 in a region between the intake-side cam sprocket 32 and the exhaust-side cam sprocket 33. The second guide 40 functions to guide the first timing chain 34, On the other hand, an oil pump-driving oil pump sprocket 41 and a balancer sprocket 42 are provided at positions below the crank sprocket 31, and a second timing chain 43 serving as a second endless transmission band is wound around the above sprockets 31, 41, 42 to form an oil pump-driving transmission mechanism 44 based on these elements 31, 41, 42, 43.

A second lever 47 is provided outside a running line of the second timing chain 43 in a region between the crank sprocket 31 and the balancer sprocket 42, and configured such that a free end thereof is adjustably pressed by a second hydraulic tensioner 46, and swung about a support point 45. The second hydraulic tensioner 46 and the second lever 47 function to prevent slack of the second timing chain 43.

Further, a third guide 49 is provided outside and along the running line of the second timing chain 43 in a region between the crank sprocket 31 and the oil pump sprocket 41. The third guide 48 functions to guide the second timing chain 43.

Here, the above tensioners 37, 46, the levers 38, 47, and the guides 39, 40, 48 are provided on the side of the engine body 11, and the crank sprockets 30, 32 are configured to be driven in a counterclockwise direction (direction indicated by the arrowed line d) in FIG. 1.

As depicted in FIG. 1, the timing chain cover 20 is formed with a mating face 20*a* and a mating face 20*a* with the engine body, wherein the mating face 20*a* is disposed on an intake side to extend approximately in an upward-downward direction and, the mating face 20*b* id disposed on an exhaust side to extend approximately in an upward-downward direction, and formed with an upper end face 20*c* serving as a mating face with the head cover, and an lower end face 20*d* serving as a mating face with the oil pan.

Here, as depicted in FIG. 1, in this embodiment, the oil passage coupling section 23 in which the first mating face 13 is coupled to the second mating face 22 is provided by a number of three in total.

Specifically, as depicted in FIG. 1, the total three oil passage coupling sections 23 consist of: a first passage coupling section 23A and a second passage coupling section 23B each provided inside a region surrounded by the first timing chain 34, as viewed in the cylinder row direction X, and below the intake-side cam sprocket 32 and the exhaust-side cam sprocket 33 around which the first timing chain 34 is wound; and a third passage coupling section 23C provided outside the region surrounded by the first timing chain 34, as viewed in the cylinder row direction X, and below the exhaust-side cam sprocket 33.

Figure 3:
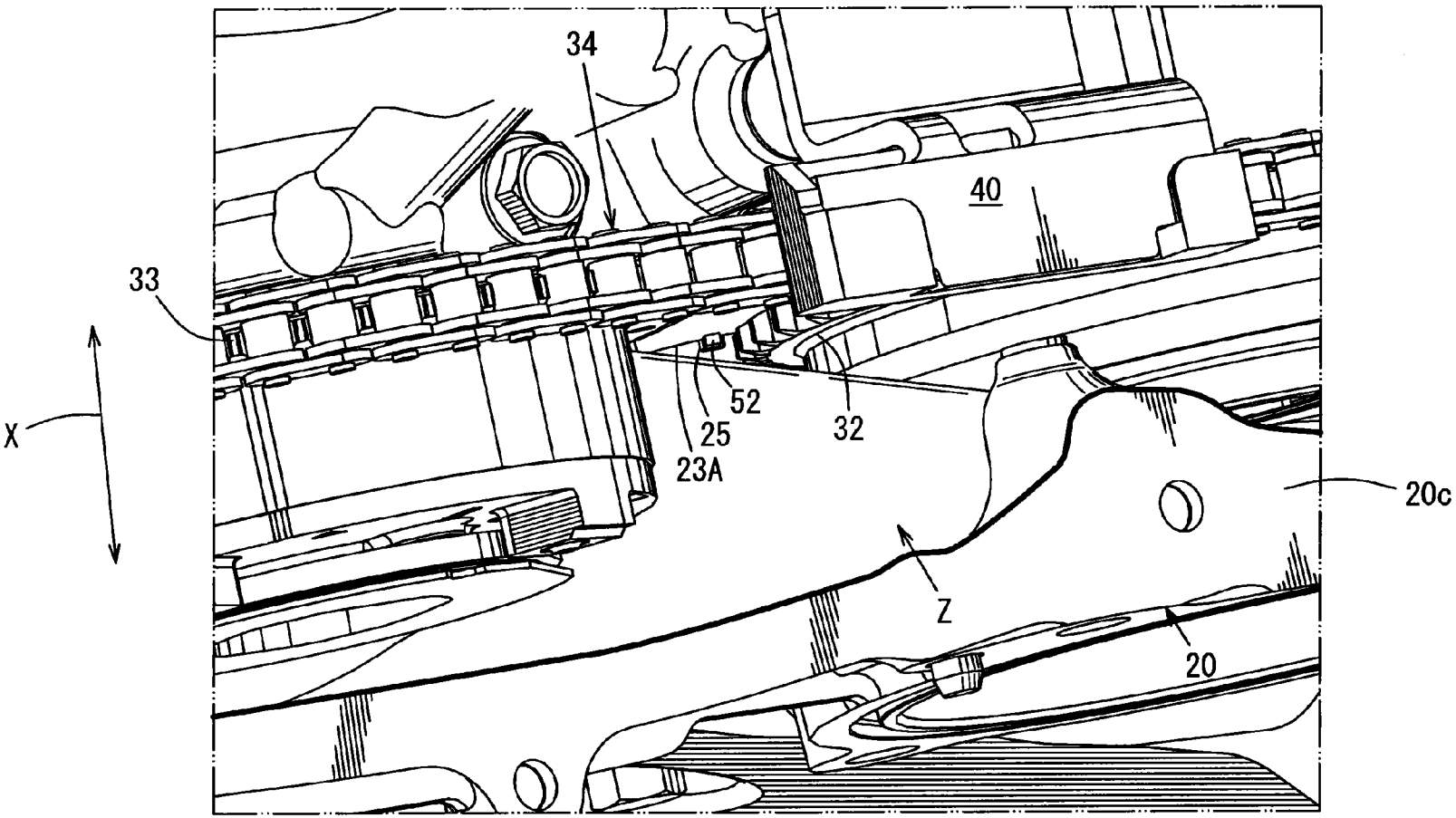
FIG. 3 is a perspective view depicting the oil passageway structure in FIG. 1, when viewing a portion a in FIG. 1 from an upper region of an engine approximately in a cylinder axis direction.
Figure 4:
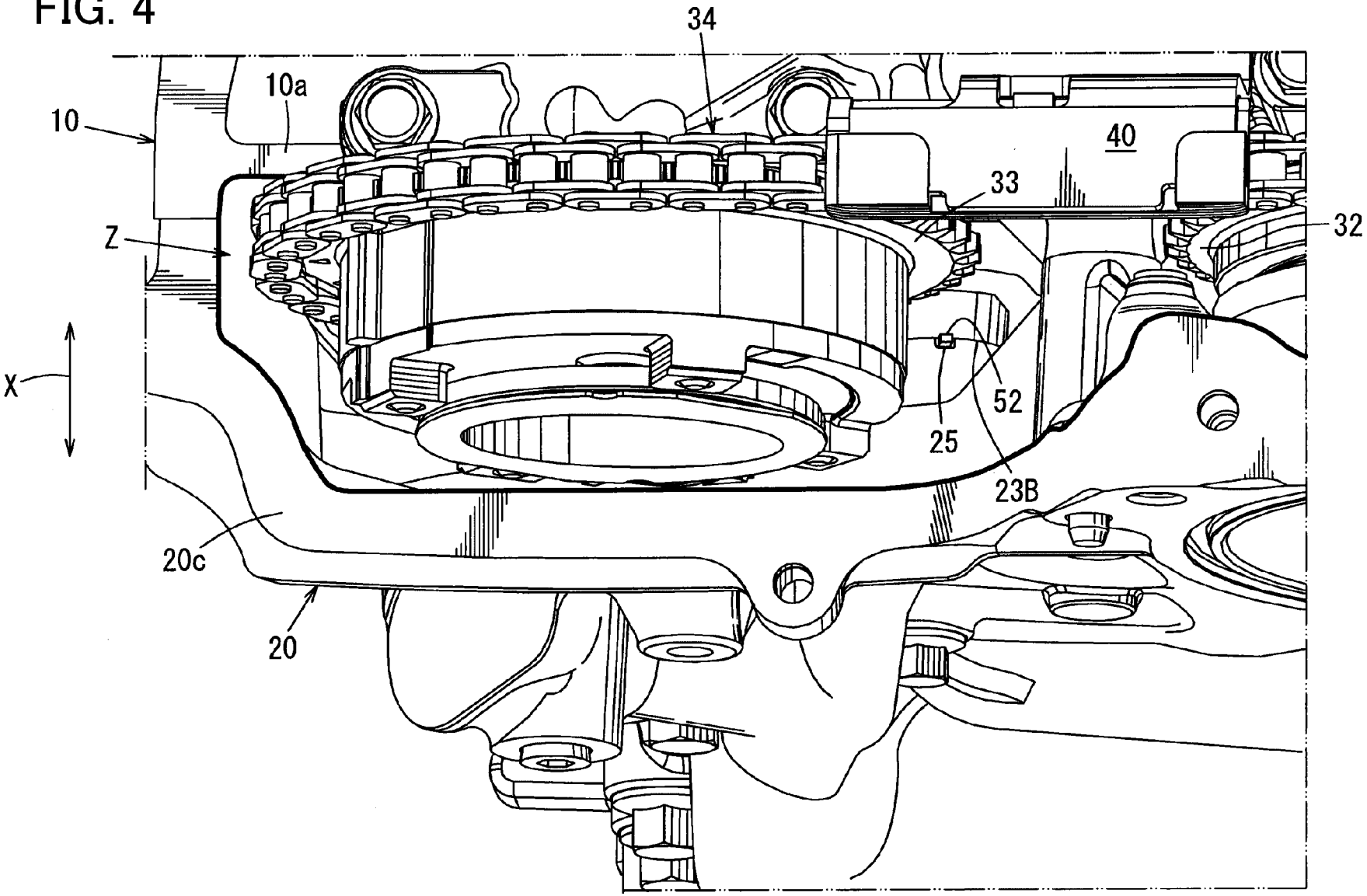
FIG. 4 is a perspective view depicting the oil passageway structure in FIG. 1, when viewing a portion b in FIG. 1 from the upper region of the engine approximately in the cylinder axis direction.
Figure 5:
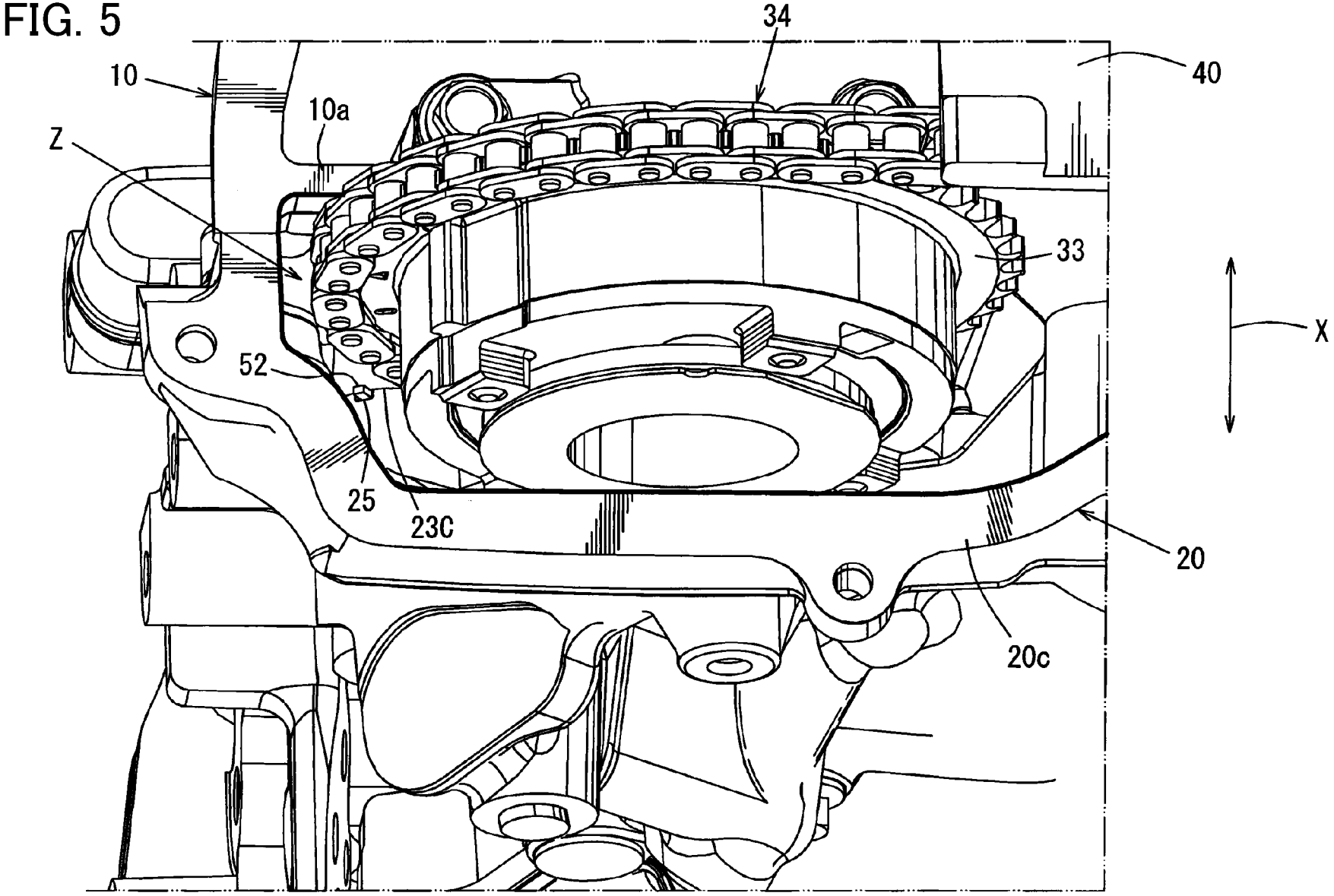
FIG. 5 is a perspective view depicting the oil passageway structure in FIG. 1, when viewing a portion c in FIG. 1 from the upper region of the engine approximately in the cylinder axis direction.

FIG. 3 is a perspective view depicting the oil passageway structure in FIG. 1, when viewing a portion a in FIG. 1 (first passage coupling section 23A) from an upper region of the engine approximately in the cylinder axis direction, and FIG. 4 is a perspective view depicting the oil passageway structure in FIG. 1, when viewing a portion b in FIG. 1 (second passage coupling section 23B) from the upper region of the engine approximately in the cylinder axis direction. FIG. 5 is a perspective view depicting the oil passageway structure in FIG. 1, when viewing a portion c in FIG. 1 (third passage coupling section 23C) from the upper region of the engine approximately in the cylinder axis direction.

Figure 6A:
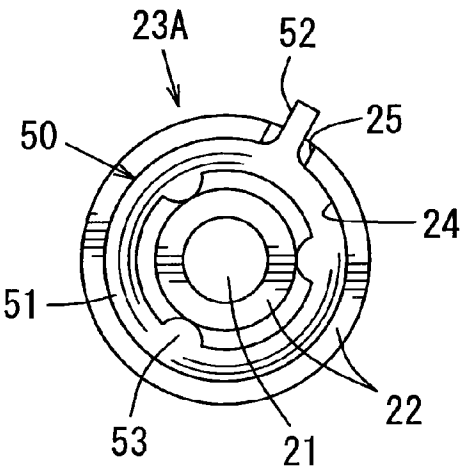
FIG. 6A is an enlarged view of the portion a in FIG. 1.
Figure 6B:
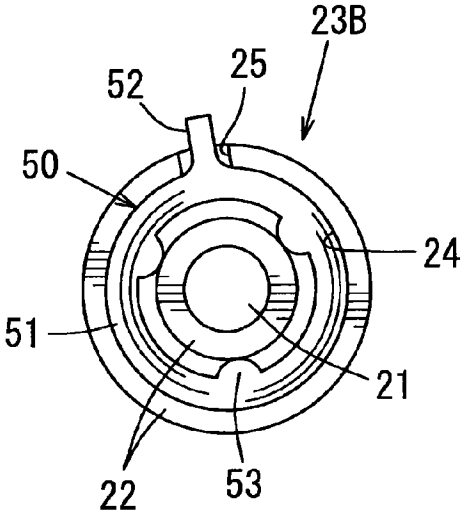
FIG. 6B is an enlarged view of the portion b in FIG. 1.
Figure 6C:
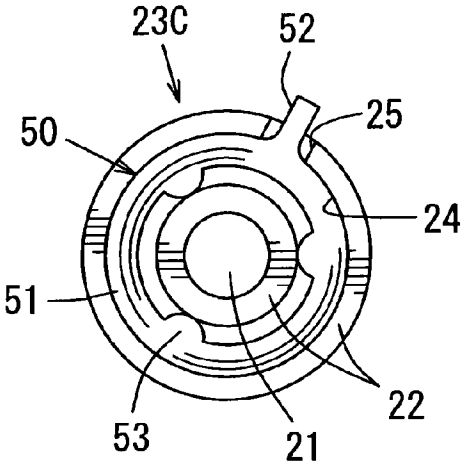
FIG. 6C is an enlarged view of the portion c in FIG. 1.

As depicted in FIGS. 6A, 6B and 6C, a sealing member-receiving groove 24 is provided in the first mating face 13 or the second mating face 22 in each of the first, second and third passage coupling sections 23A, 23B, 23C. In this embodiment, this groove 24 is recessedly formed in the second mating face 22. This groove 24 is provided as a means to receive therein the aftermentioned sealing member 50, and formed in an annular shape.

Here, it is preferable to provide the groove 24 in the second mating face 22 having the cover-side oil passage 21, as in this embodiment. Alternatively, in this embodiment, the groove 24 may be provided in the first mating face 13 having the body-side oil passage 12, or may be provided in both the first mating face 13 and the second mating face 22.

A linear-shaped cutout 25 is provided in the mating face in which the groove 24 is recessedly formed, i.e., the second mating face, to extend from an engine upper region-facing side of the groove 24 outwardly in a radial direction of the cover-side oil passage 21, and open to an outer periphery of the second mating face 22.

Then, as depicted in FIGS. 6A, 6B and 6C, a sealing member 50 (so-called "sealing") having an approximately ring shape corresponding to the annular shape of the groove 24.

Here, the risk of drop-off of the sealing member 50 is avoided by attaching the sealing member 50 to the groove 24 in the second mating face 22 formed on the timing chain cover 20. Specifically, the timing chain cover 20 is generally assembled to the engine body 11 at a final stage of an engine assembling process. Thus, the risk of drop-off of the sealing member 50 is avoided by attaching the sealing member 50 to this timing chain cover 20.

Figure 7B:
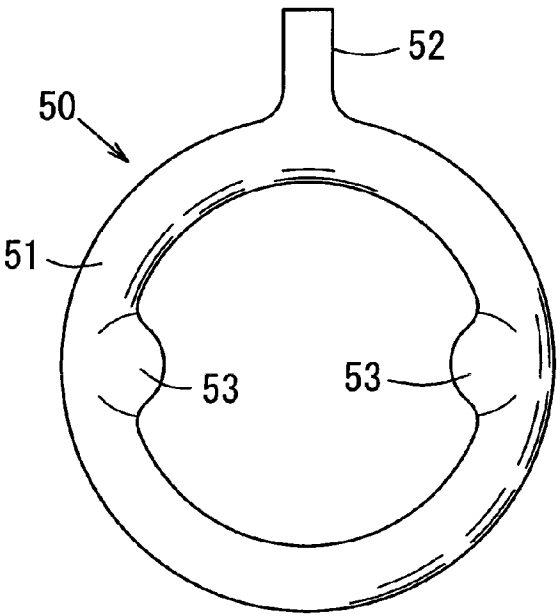
FIG. 7B is a front view depicting one modification of the sealing member in the oil passageway structure according to this embodiment.
Figure 7A:
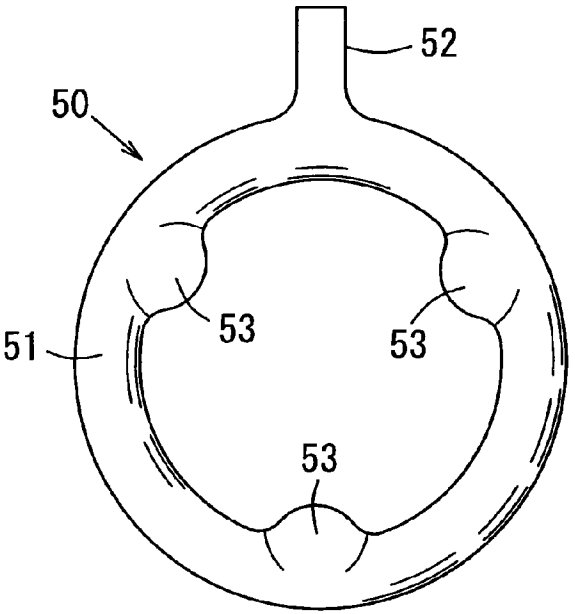
FIG. 7A is a front view depicting a sealing member in the oil passageway structure according to this embodiment.
Figure 8B:
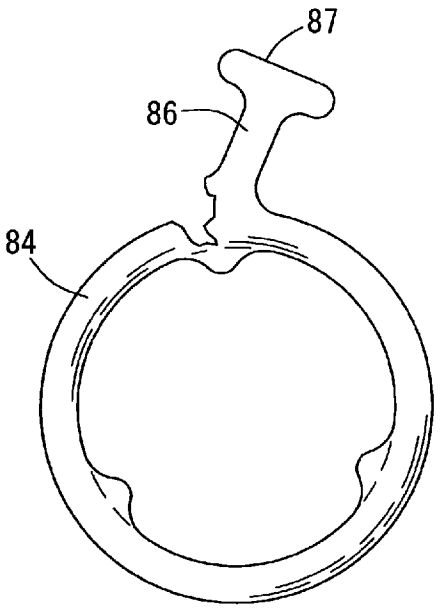
FIG. 8B is an explanatory diagram depicting a broken state of the sealing member in the comparative example depicted in FIG. 8.
Figure 8A:
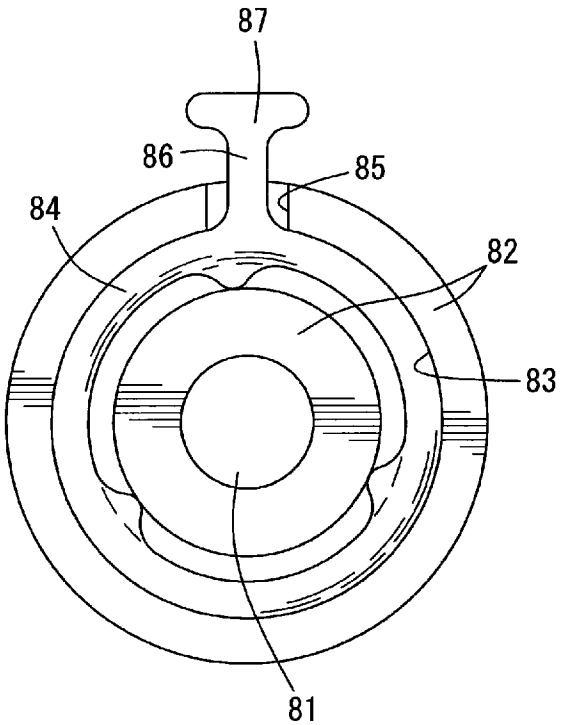
FIG. 8A is a front view depicting an oil passage coupling section and a sealing member in a comparative example with respect to the present invention.

As depicted in FIG. 7A, the sealing member 50 is integrally formed with: an annular-shaped sealing member body 51; an outer protrusion 52 protruding upwardly from an engine upper region-facing outer periphery of the sealing member body 51, in conformity to the shape of the cutout 25 and then beyond an outer periphery-side end of the cutout 25; and plural inward protrusions 53 each formed on an inner periphery of the sealing member body 51 to protrude radially inwardly. Here, the inward protrusions 53 are provided as a means to prevent drop-off of the sealing member.

The inward protrusions 53 depicted in FIG. 7A are provided offset with respect to the outward protrusion 52 in a circumferential direction of the sealing member 50. Further, with a view to distributing a pressure during flowing of oil, uniformly in the circumferential direction of the sealing member body 51, they are provided on the inner periphery of the sealing member body 51 by a number of three in total, at even intervals of 120 degrees.

In place of the structure of the sealing member 50 depicted in FIG. 7A, the inward protrusion 53 may be provided on the inner periphery of the sealing member body 51 by a number of two in total, at even intervals of 180 degrees, as depicted in FIG. 7B.

Further, as depicted in FIGS. 1, 6A, 6B and 6C, the cutout 25 formed in the second mating face 22 is formed inclinedly with respect to the cylinder axis Y (which means a central axis of each cylinder bore; see FIG. 1) as viewed in the cylinder row direction X. Thus, when viewing each of the first, second and third oil passage coupling sections 23A, 23B, 23C from the upper region of the engine (specifically, from above a sealing member assembling state-checking opening Z defined between an upper end 10*a* at one end of the cylinder head 10 in the cylinder row direction X and an upper end face of the timing chain cover 20; for the sake of illustration, this opening Z is indicated in a surrounding manner by a thick line in FIGS. 4 and 6) approximately in the cylinder axis direction, a projection area of the outward protrusion 52 of the sealing member 50 can be ensured largely.

As depicted in FIGS. 1, 6A and 6B, each of the cutouts 25 of the first passage coupling section 23A and the second passage coupling section 23B provided inside the region surrounded by the first timing chain 34 is formed such that it is oriented toward an interspace 49 defined between the intake-side cam sprocket 32 and the exhaust-side cam sprocket 33, as viewed in the cylinder row direction X.

Specifically, the cutout 25 in the first passage coupling section 23A is inclined with respect to the cylinder axis Y, toward the interspace 49 by an angle ranging from 25 to 35 degrees (in this embodiment, 28 degrees), as viewed in the cylinder row direction X. Thus, as depicted in FIG. 3, when viewing the first passage coupling section 23A from the upper region of the engine approximately in the cylinder axis direction, during an engine assembling process before attaching the head cover, the projection area of the outward protrusion 52 of the sealing member 50 can be increased.

Further, the cutout 25 in the second passage coupling section 23B is inclined with respect to the cylinder axis Y, toward the interspace 49 by an angle ranging from 10 to 20 degrees (in this embodiment, 15 degrees), as viewed in the cylinder row direction X. Thus, as depicted in FIG. 4, when viewing the second passage coupling section 23B from the upper region of the engine approximately in the cylinder axis direction, during the engine assembling process before attaching the head cover, the projection area of the outward protrusion 52 of the sealing member 50 can be increased.

Further, as depicted in FIGS. 1 and 6C, the cutout 25 in the third passage coupling section 23C provided outside the region surrounded by the first timing chain 34 is formed such that it is oriented toward the outer edge of the timing chain cover 20, as viewed in the cylinder row direction X.

Specifically, the cutout 25 in the third passage coupling section 23C is inclined with respect to the cylinder axis Y, toward an exhaust-side outer edge of the timing chain cover 20 by an angle ranging from 25 to 35 degrees (in this embodiment, 27.5 degrees), as viewed in the cylinder row direction X. Thus, as depicted in FIG. 5, when viewing the third passage coupling section 23C from the upper region of the engine approximately in the cylinder axis direction, during the engine assembling process before attaching the head cover, the projection area of the outward protrusion 52 of the sealing member 50 can be increased.

Further, as depicted in FIGS. 1 and 3 to 5, when visually checking downwardly from above the opening Z, all the passage coupling sections 23A, 23B, 23C are disposed offset in a width direction of the engine body to maximally avoid a situation where an object blocking the engine upper region side of the passage coupling sections 23A, 23B, 23C is disposed between each of the passage coupling sections 23A, 23B, 23C and the opening Z, so that it is possible to visually check all the outward protrusions.

As above, the oil passageway structure according to the above embodiment comprises: a body-side oil passage 12 formed inside an engine body 11 having plural cylinders; a cover-side oil passage 21 formed inside an endless transmission band cover (see the timing chain cover 20) which is attached to a lateral surface of one end in a cylinder row direction of the engine body 11; an oil passage coupling section (23A, 23B, 23C) in which a first mating face 13 formed around a peripheral edge of an endless transmission band cover-facing open end of the body-side oil passage 12 is coupled to a second mating face formed around a peripheral edge of a body-side oil passage (21)-facing open end of the cover-side oil passage 21; an approximately annular-shaped groove 24 formed in at least one of the first mating face 13 and the second mating face 22; a cutout 25 formed in the at least one mating face to extend from an engine upper region-facing side of the groove 24 outwardly in a radial direction of an associated one of the oil passages (see the cover-side oil passage 21) and open to an outer edge of the at least one mating face (see the first mating face 13 and the second mating surface 22); and a sealing member 50 formed in a shape corresponding to that of the groove 24 and attached to the groove 24, wherein the sealing member 50 is formed with an outward protrusion 52 having a shape corresponding to that of the cutout 25 and protruding upwardly from an outer periphery of the sealing member 50, beyond an outer edge-side end of the cutout 25, and the cutout 25 is formed inclinedly with respect to a cylinder axis Y as viewed in the cylinder row direction X (see FIGS. 1, 2 and 6).

The engine upper region-facing side of the groove 24 means, when the groove 24 is divided by a horizontal line passing through a center of the groove 24, into an upper region and a lower region as viewed in the cylinder row direction, a region corresponding to the upper side.

In the oil passageway structure according to the above embodiment having the above feature, the cutout 25 (assembling state-checking cutout) formed to communicate with the groove 24 is provided obliquely or inclinedly with respect to the cylinder axis Y, so that it is possible to largely ensure a projection area of the outward protrusion 52 of the sealing member 50, when viewing the oil passage coupled section (23A, 23B, 23C) from an upper region of the engine approximately in the cylinder axis direction. This makes it possible to enhance visibility of the outward protrusion 52, and effectively visually check the presence or absence of attachment of the sealing member 50 within a short period of time during conveyance of the engine on a conveyer belt in an engine assembling process.

Further, even in a situation where components are disposed above the oil coupled section (23A, 23B, 23C), the cutout 25 disposed inclinedly facilitates checking of the assembling state from an inter-component space.

In addition, the outward protrusion 52 of the sealing member 50 can be formed such that it is maximally reduced in size, so that, even if the outward protrusion 52 swings due to engine vibration, the resulting fatigue stress to be applied to a base end of the outward protrusion 52 can be reduced, thereby improving durability of the sealing member 50.

In the oil passageway structure according to the above embodiment, as viewed in the cylinder row direction X, the oil passage coupling section (see the third passage coupling section 23C) is provided outside a region surrounded by the endless transmission band (see the first timing chain 34), and the cutout 25 is formed such that it is oriented toward an outer edge of the endless transmission band cover (see the timing chain cover 20) (see FIGS. 1 and 6C)).

According to this feature, the cutout 25 is oriented toward the outer edge of the endless transmission band cover (the timing chain cover 20), so that it is possible to prevent a distal end of the outward protrusion 52 of the sealing member 50 from being oriented toward the endless transmission band line (the running line of the timing chain 34), so as to avoid overlapping between the outward protrusion 52 and a region to be darkened by a shadow of the endless transmission band (the timing chain 34), when visually checking the outward protrusion 52 from the upper region of the engine, thereby enhancing visibility of the outward protrusion.

Further, it is possible to prevent a contact between the endless transmission band (the timing chain 34) and the outward protrusion 52 of the sealing member 50, which would otherwise be caused by fluttering of the endless transmission band (the timing chain 34) during engine operation.

In the oil passageway structure according to the above embodiment, the oil passage coupling section (see the first passage coupling section 23A or the second passage coupling section 23B) is provided inside a region surrounded by the endless transmission band (see the first timing chain 34), and below an intake-side camshaft drive wheel (see the intake-side cam sprocket 32) and an exhaust-side camshaft drive wheel (see the exhaust-side cam sprocket 33) around which the endless transmission band (see the first timing chain 34) is wound, and the cutout 25 is formed such that it is oriented toward an interspace 49 between the intake-side camshaft drive wheel (see the intake-side cam sprocket 32) and the exhaust-side camshaft drive wheel (see the exhaust-side cam sprocket 33), as viewed in the cylinder row direction (FIGS. 1, 6A and 6B).

According to this feature, the cutout 25 is oriented toward the interspace between the intake-side and exhaust-side camshaft drive wheels (can sprockets 32, 33), so that it is possible to ensure visibility, particularly, visibility of the outward protrusion 52 of the sealing member 50, when visually checking the cutout 25 from the upper region of the engine.

In the oil passageway structure according to the above embodiment, the groove 24 is provided in the second mating face 22 (see FIGS. 2 and 6).

According to this feature, the groove 24 is provided in the second mating face 22 of the endless transmission band cover (the timing chain cover 20), so that the sealing member 50 can be preliminarily attached to the groove 24. This makes it possible to prevent drop-off of the sealing member 50 during an engine assembling process and improve assembling efficiency.

On the other hand, assume that the groove is provided in the first mating face on the side of the engine body, and the sealing member is preliminarily attached to the groove on the side of the engine body. In this case, the sealing member is likely to drop off during assembly of the endless transmission band and others. Further, even if the sealing member is attached after assembling of the endless transmission band, this sealing member has to be pressed into the groove, resulting in poor assembling efficiency. Therefore, in the above embodiment, the groove 24 is provided in the second mating face 22 of the endless transmission band cover In the oil passageway structure according to the above embodiment, the sealing member 50 is formed in an annular shape, wherein the sealing member 50 has an inward protrusion 53 protruding radially inwardly from an inner periphery of the sealing member 50, and wherein the inward protrusion 53 is provided offset with respect to the outward protrusion 52, in a circumferential direction of the sealing member 50 (see FIGS. 6 and 7)

According to this feature, when oil flows through the oil passages during engine operation, a pressure (internal pressure) is applied to the sealing member 50 from the side of the inner periphery toward the outer periphery of the sealing member 50. At this timing, a load is mainly input via the inner protrusion 53, so that it is possible to suppress a situation where stress is abnormally increased in a part of the sealing member 50 corresponding to a connection between the groove 24 and the cutout 25, thereby suppressing deterioration in durability of the sealing member 50.

Here, in a correspondence between the present invention (defined by the appended claims) and the above embodiment, the endless transmission band, the intake-side camshaft drive wheel, and the exhaust-side camshaft drive wheel in the present invention correspond, respectively, to the first timing chain 34, the intake-side cam sprocket 32, and the exhaust-side cam sprocket 33 in the above embodiment, It is to be understood that the present invention is not limited to the configuration of the above embodiment. For example, a timing belt may be employed in place of the timing chain, and, as a camshaft drive wheel, a timing pulley may be employed in place of the can sprocket.

INDUSTRIAL APPLICABILITY

As described above, the present invention is useful in an oil passageway structure for an engine, which comprises a body-side oil passage formed inside an engine body internally having plural cylinders, and a cover-side oil passage formed inside an endless transmission band cover provided at one end in a cylinder row direction of the engine body.

LIST OF REFERENCE SIGNS

11: engine body
12: body-side oil passage
13: first mating face
20: timing chain cover (endless transmission band cover)
21: cover-side oil passage
22: second mating face
23, 23A, 23B, 23C: passage coupling section
24: groove
25: cutout
32: intake-side cam sprocket (intake-side camshaft drive wheel)
33: exhaust-side cam sprocket (exhaust-side camshaft drive wheel)
34: first timing chain (endless transmission band)
49: interspace
50: sealing member
52: outward protrusion
53: inward protrusion

The invention claimed is:

1. An oil passageway structure for an engine, which comprises:

a body-side oil passage formed inside an engine body having plural cylinders;

a cover-side oil passage formed inside an endless transmission band cover which is attached to a lateral surface of one end in a cylinder row direction of the engine body, and covers an endless transmission band;

an oil passage coupling section in which a first mating face formed around a peripheral edge of an endless transmission band cover-facing open end of the body-side oil passage is coupled to a second mating face formed around a peripheral edge of a body-side oil passage-facing open end of the cover-side oil passage;

an approximately annular-shaped groove formed in at least one of the first mating face and the second mating face;

a cutout formed in the at least one mating face to extend from an engine upper region-facing side of the groove outwardly in a radial direction of an associated one of the oil passages and open to an outer edge of the at least one mating face; and a sealing member formed in a shape corresponding to that of the groove and attached to the groove, wherein the sealing member is integrally formed with an annular-shaped sealing member body, an outward protrusion having a shape corresponding to that of the cutout and protruding upwardly from an outer periphery of the sealing member, beyond an outer edge-side end of the cutout, and a plurality of inward protrusions formed on an inner periphery of the sealing member body to protrude radially inwardly, the cutout is formed inclinedly with respect to a cylinder axis as viewed in the cylinder row direction, and the plurality of inward protrusions are provided offset with respect to the outward protrusion in a circumferential direction of the sealing member and are provided on the inner periphery of the sealing member body at predetermined intervals.

2. The oil passageway structure according to claim 1, wherein, as viewed in the cylinder row direction, the oil passage coupling section is provided outside a region surrounded by the endless transmission band, and the cutout is formed such that it is oriented toward an outer edge of the endless transmission band cover.

3. The oil passageway structure according to claim 1, wherein the oil passage coupling section is provided inside a region surrounded by the endless transmission band, and below an intake-side camshaft drive wheel and an exhaust-side camshaft drive wheel around which the endless transmission band is wound, and the cutout is formed such that it is oriented toward an interspace between the intake-side camshaft drive wheel and the exhaust-side camshaft drive wheel, as viewed in the cylinder row direction.

4. The oil passageway structure according to claim 1, wherein the groove is provided in the second mating face.

5. The oil passageway structure according to claim 2, wherein the groove is provided in the second mating face.

6. The oil passageway structure according to claim 3, wherein the groove is provided in the second mating face.

7. The oil passageway structure according to claim 1, wherein the oil passage coupling section is provided inside a region surrounded by the endless transmission band, as viewed in the cylinder row direction, and below an intake-side camshaft drive wheel around which the endless transmission band is wound.

8. The oil passageway structure according to claim 1, wherein the oil passage coupling section is provided inside a region surrounded by the endless transmission band, as viewed in the cylinder row direction, and below an exhaust-side camshaft drive wheel around which the endless transmission band is wound.

9. The oil passageway structure according to claim 1, wherein the oil passage coupling section is provided outside a region surrounded by the endless transmission band, as viewed in the cylinder row direction, and below an exhaust-side camshaft drive wheel around which the endless transmission band is wound.

10. The oil passageway structure according to claim 1, wherein the oil passage coupling section includes a first oil passage coupling section and a second oil passage coupling section, each provided inside a region surrounded by the endless transmission band, as viewed in the cylinder row direction, and below an intake-side camshaft drive wheel around which the endless transmission band is wound, and a third oil passage coupling section, which is provided outside the region surrounded by the endless transmission band, as viewed in the cylinder row direction, and below an exhaust-side camshaft drive wheel around which the endless transmission band is wound.

11. The oil passageway structure according to claim 10, wherein the cutout includes a first cutout provided in the first oil passage coupling section and a second cutout provided in the second oil passage coupling section, each of the first cutout and second cutout being inclined, as viewed in the cylinder row direction, toward an interspace between the intake-side camshaft drive wheel and the exhaust-side camshaft drive wheel.

* * * * *